US006435357B1

(12) United States Patent
Lee

(10) Patent No.: US 6,435,357 B1
(45) Date of Patent: Aug. 20, 2002

(54) TOOL HOLDING DEVICE

(76) Inventor: Ming-Hui Lee, No. 3, Lane 27, Yung-Hua St., Changhua City (TW)

( * ) Notice: Subject to any disclaimer, the term of this patent is extended or adjusted under 35 U.S.C. 154(b) by 0 days.

(21) Appl. No.: 09/835,234

(22) Filed: Apr. 16, 2001

(51) Int. Cl.[7] ..... A47F 7/00; A47F 5/08

(52) U.S. Cl. ..... 211/70.6; 211/94.01; 248/110

(58) Field of Search ..... 211/94.01, 89.01, 211/70.6, 65, 66, 68, 60.1; 312/206–207; 248/110, 113, 316.2, 309.1, 316.3, 316.7, 316.8, 316.1, 224.61, 224.51

(56) References Cited

U.S. PATENT DOCUMENTS 2,869,209 A * 1/1959 Kautzky ..... 248/110
3,146,732 A * 9/1964 Tozier ..... 211/94.01
3,178,141 A * 4/1965 Bloom ..... 211/66
4,209,098 A * 6/1980 Adams ..... 211/60.1
4,749,160 A * 6/1988 Shih ..... 248/316.1
4,771,897 A * 9/1988 Ho ..... 211/94.01
4,852,747 A * 8/1989 Breveglieri ..... 211/70.6
4,880,192 A * 11/1989 Vom Braucke et al. ..... 248/110
5,165,629 A * 11/1992 Breveglieri ..... 248/110
5,342,010 A * 8/1994 Huang ..... 248/316.3
5,412,912 A * 5/1995 Alves ..... 211/94.01
5,687,856 A * 11/1997 Kendrena ..... 211/70.6
5,711,430 A * 1/1998 Andersen et al. ..... 211/89.01
5,740,927 A * 4/1998 Yemini ..... 211/70.6
5,955,170 A * 9/1999 Davis et al. ..... 248/16.7
6,152,312 A * 11/2000 Nava et al. ..... 211/94.01
6,164,467 A * 12/2000 DePottey et al. ..... 211/87.01

* cited by examiner

*Primary Examiner*—Daniel P. Stodola
*Assistant Examiner*—Jennifer E. Novosad
(74) *Attorney, Agent, or Firm*—Charles E. Baxley

(57) ABSTRACT

A tool holding device includes a channel member having grooves defined in two opposed longitudinal sides thereof so that a clamping assembly is movably engaged between the two grooves. A second groove is defined in a surface of at least one of the sides so that a connection portion of a hook assembly is engaged with the second groove. Two holes are defined in the clamping assembly and a fixed member extends from the clamping assembly. A clamp member is eccentrically engaged with one of the two holes so as to pivotably clamp a shank of a tool against the fixed member.

6 Claims, 6 Drawing Sheets

TOOL HOLDING DEVICE

FIELD OF THE INVENTION

The present invention relates to a tool holding device on a wall wherein the device can be adjustable to clamp tools with different size of shanks.

BACKGROUND OF THE INVENTION

A conventional tool holding device is shown in FIG. 1 and generally includes a base plate 10 fixedly connected on a wall and a clamping device 11 is fixedly connected on the base plate 10 by bolts 13 extending through the clamping device 11 and holes 12 in the base plate 10. The clamping device 11 has a clamp member 14 and a fixed member 16 wherein the clamp member 14 is pivotably connected to the body of the clamping device 11 and the fixed member 16 is located at a distance from the clamp member 14. The clamp member 14 has a curved surface 141 and when a shank 15 of a tool is located between the clamp member 14 and the fixed member 16, the shank 15 is clamped between the clamping device 11 and the fixed member 16. However, the distance between the clamping device 11 and the fixed member 16 is not adjustable so that the size of the shanks of tools are limited. In other words, if the size of the shank 15 is too small or too large, it is not held by the holding device.

The present invention intends to provide a tool holding device wherein the clamp member can be easily shifted to clamp thinner shank.

SUMMARY OF THE INVENTION

In accordance with one aspect of the present invention, there is provided a tool holding device which comprises a channel member having a bottom and grooves defined in two opposed longitudinal sides defining a channel there between and a second groove is defined in a surface of at least one of the sides of the channel member. A clamping assembly has ridges movably received in the grooves, two holes defined in the clamping assembly and a fixed member extending from the clamping assembly. A clamp member has a passage defined eccentrically therein and a pin removably extends through the passage and is engaged with one of the two holes. A hook assembly has a hook and a connection portion which is movably engaged with the second groove.

The primary object of the present invention is to provide a tool holding device that can be moved on the channel member and the gap between the clamp member and the fixed member of the clamping assembly can be adjustable.

The present invention will become more obvious from the following description when taken in connection with the accompanying drawings which show, for purposes of illustration only, two preferred embodiments in accordance with the present invention.

DETAILED DESCRIPTION OF THE PREFERRED EMBODIMENTS

Figure 1:
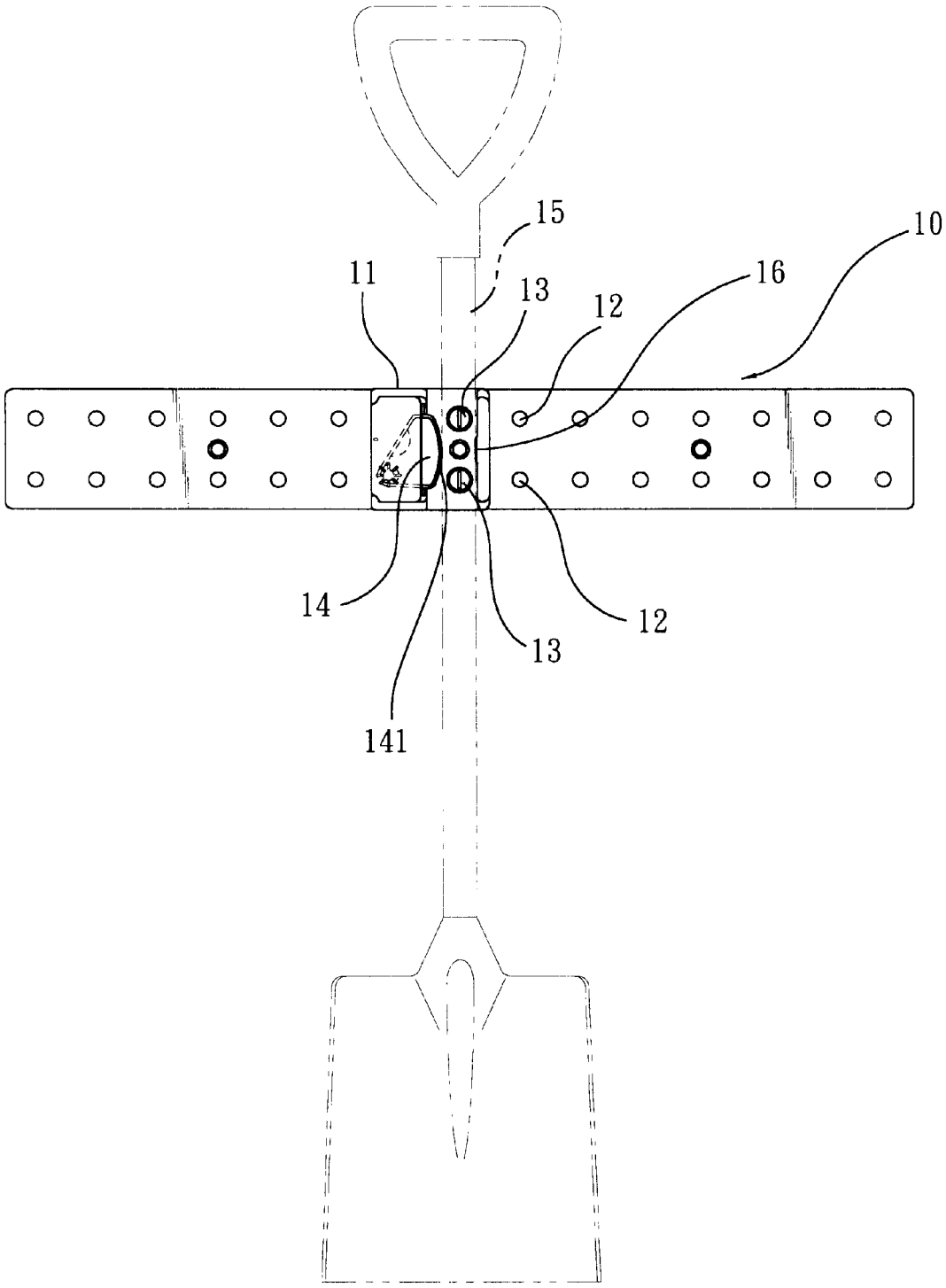
FIG. 1 PRIOR ART
FIG. 1 is a plan view to show a conventional tool holding device and a tool clamped by the conventional tool holding device.
Figure 2:
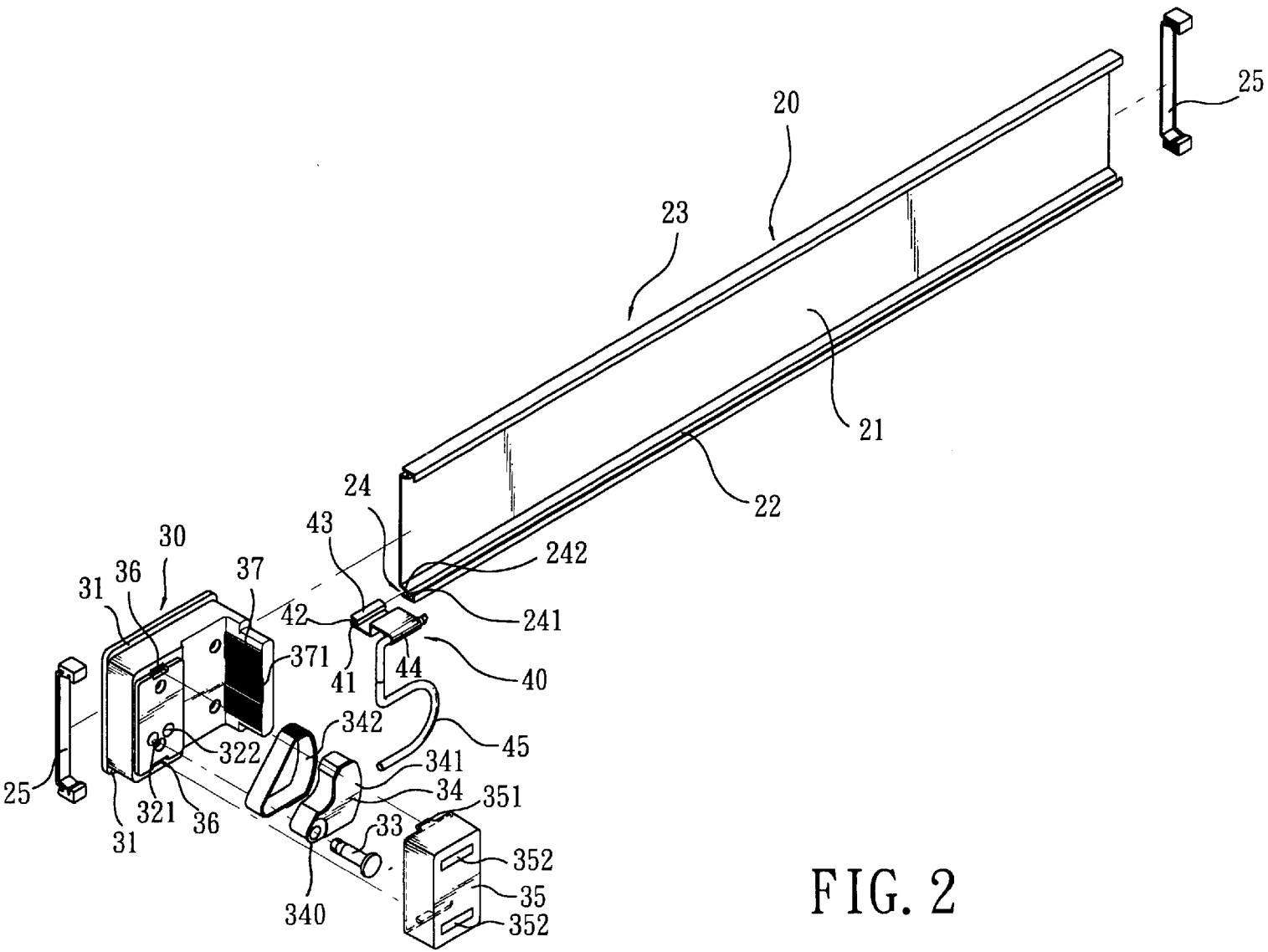
FIG. 2 is an exploded view to show a tool holding device of the present invention.
Figure 3:
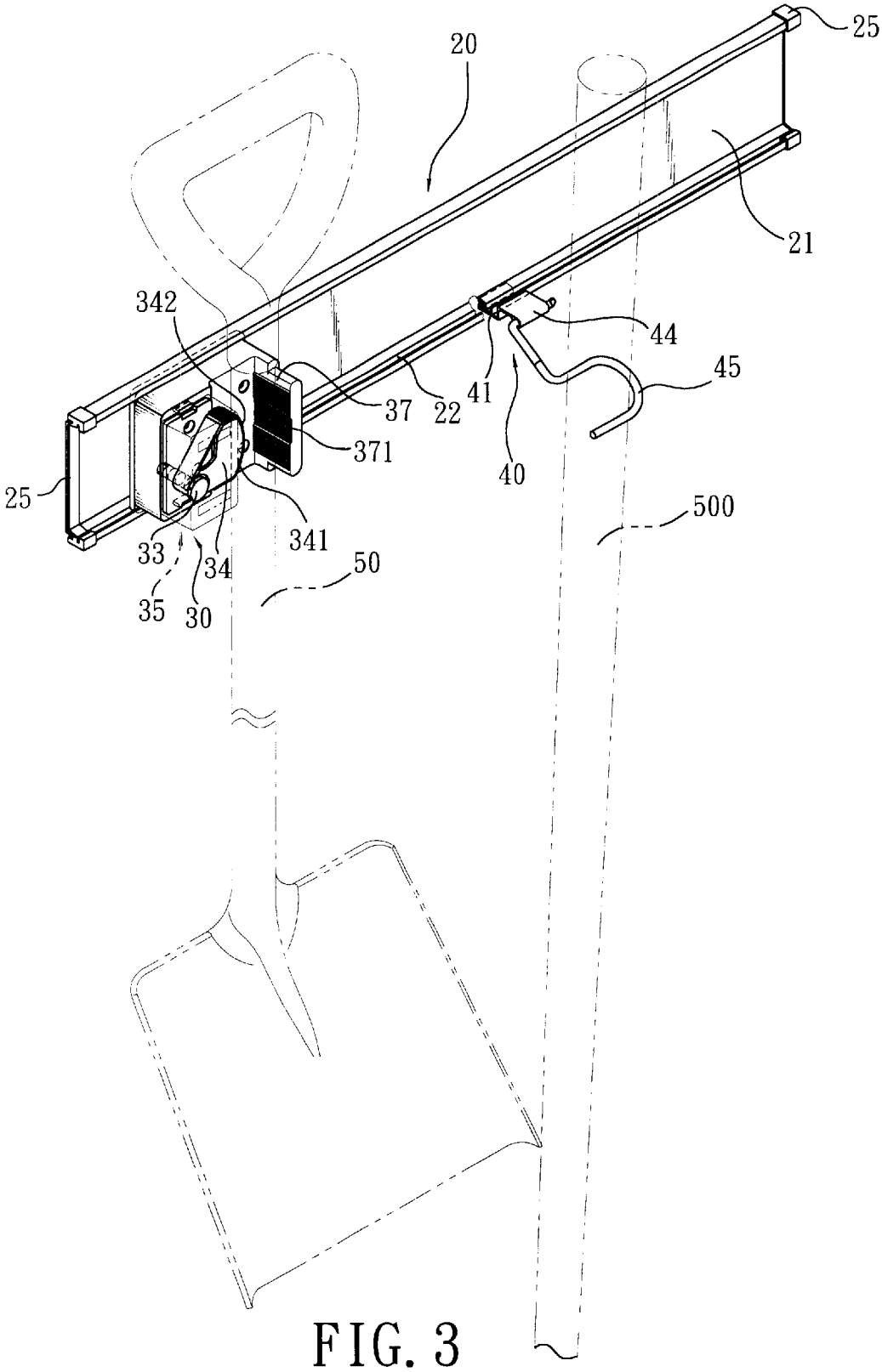
FIG. 3 is a perspective view to show the tool holding device of the present invention and two tools held by the tool holding device of the present invention.
Figure 4:
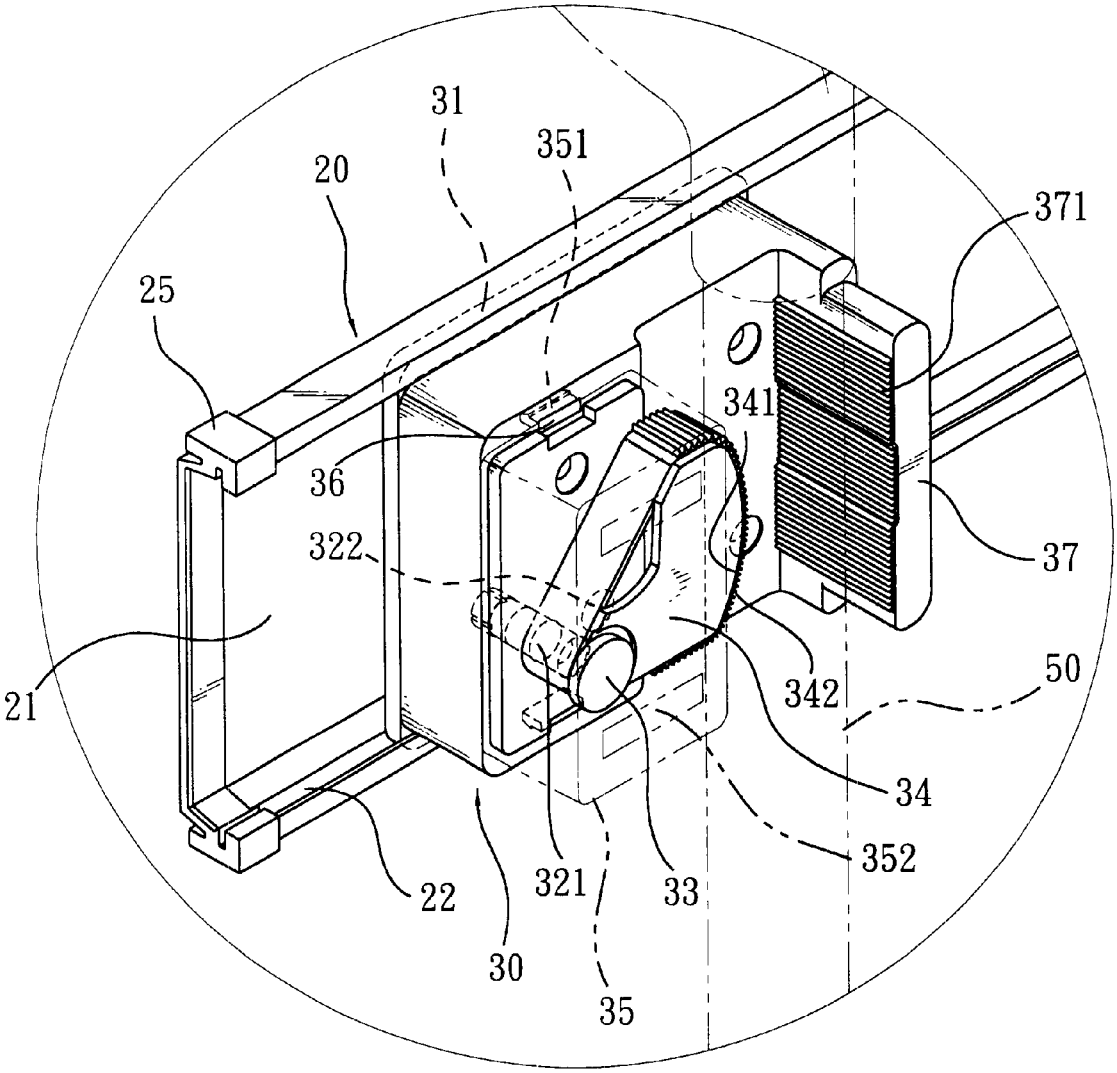
FIG. 4 is an enlarged perspective view to show the clamping assembly of the tool holding device of the present invention.

Referring to FIGS. 2 to 4, the tool holding device of the present invention comprises a channel member 20 which is fixedly connected on a wall and having two grooves 22 each defined in two opposed longitudinal sides whereby a channel 21 is defined therebetween. A second groove 24 is defined in a surface 23 of at least one of the sides the channel member 20. A flange 241 extends from a bottom (18) of the channel member 20 and the channel member 20 has a first inclined surface 242 which extends from the flange 241. A clamping assembly 30 has two ridges 31 which are movably received in the grooves 22 of the channel member 20 so that the clamping assembly 30 is movable relative to the channel member 20. Two holes 321, 322 are defined in a protrusion portion on the clamping assembly 30 and two notches 36 are defined in two ends of the protrusion portion. A fixed member 37 extends from the clamping assembly 30 and a friction surface 371 is defined in a surface of the fixed member 37. A clamp member 34 has a passage 340 defined eccentrically therein and a pin 33 removably extends through the passage 340 and is engaged with one of the two holes 321, 322. A friction belt 342 is mounted to the clamp member 34 which has a curve surface 341 facing the friction surface 371. A cover 35 is connected to the clamping assembly 30 and encloses the clamp member 34 in the cover 35. The cover 35 has two lugs 351 which are engaged with the notches 36. Two magnetic members 352 are connected on the cover 35 so that some small pieces can be attached on the cover 35. Two end members 25 are engaged on two ends of the channel member 20 and block the two grooves 22 so as to prevent the clamping assembly 30 from disengaging from the channel member 20.

Figure 5:
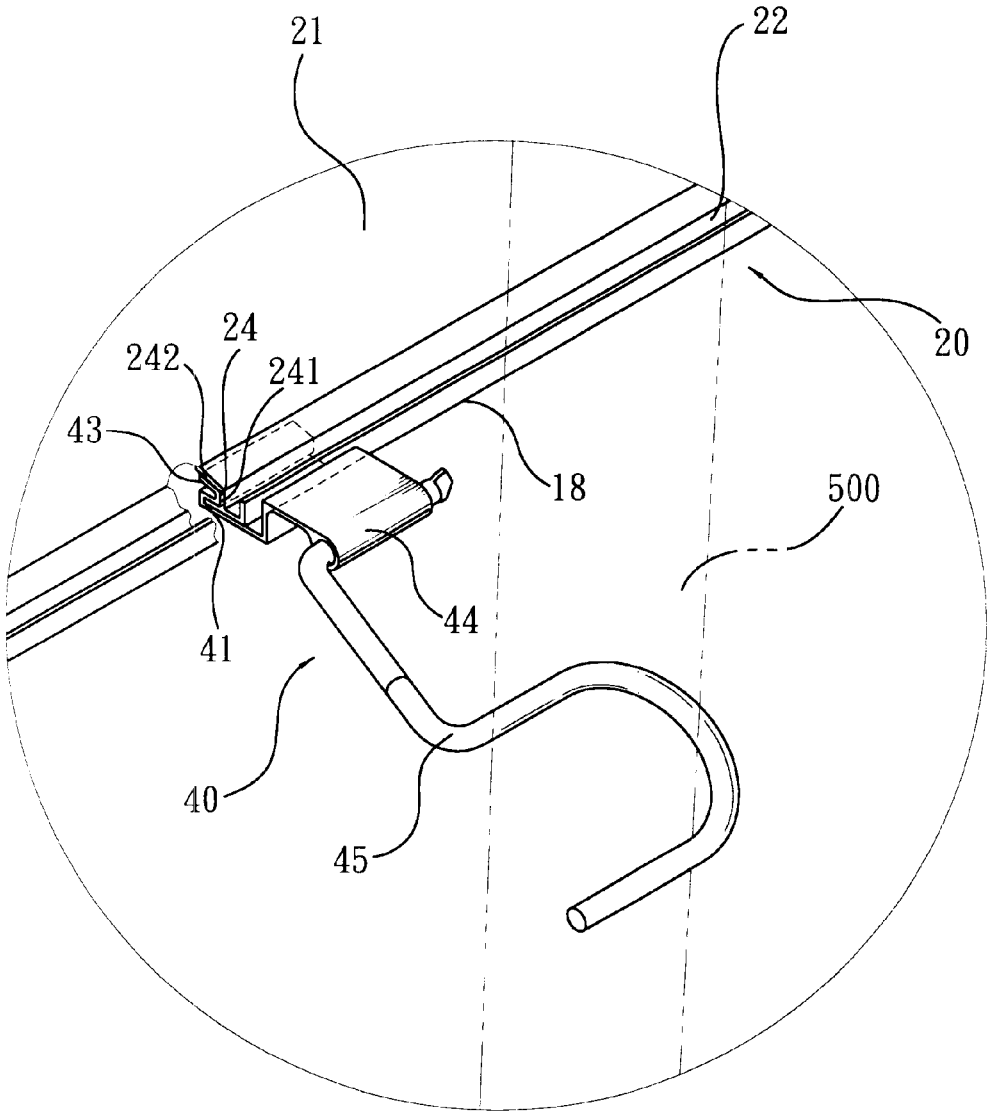
FIG. 5 is an enlarged perspective view to show the hook assembly of the tool holding device of the present invention.

Further referring to FIG. 5, a hook assembly 40 has a hook 45 and a connection portion which has a connection plate 44 and an end of the hook 45 is pivotably connected to the connection plate 44. The connection portion has a third groove 41 and a second inclined surface 43 so that the flange 241 on the channel member 20 is received in the third groove 41 and the second inclined surface 43 is engaged with the first inclined surface 242. When the hook 45 is holding a tool 500, the weight of the tool 500 makes the second inclined surface 43 firmly contact against the first inclined surface 242 so that the hook assembly 40 will not be moved randomly.

The clamp member 34 has a tendency to pivot toward the fixed member 37 because the clamp member 34 is pinned eccentrically to the clamping assembly 30. Therefore, when a shank 50 of a tool is put between the fixed member 37 and the clamp member 34, the clamp member 34 is pivoted to push the shank 50 against the friction surface 371 and to hold the shank 50. If the size of the shank 50 is too small that the clamp member 34 cannot contact, the clamp member 34 can be shifted by removing the pin 33 from the hole 321 to the other hole 322 which is located closer to the fixed member 37. By this way, the clamp member 34 is shifted closer to the fixed member 37, and a gap between the clamp member 34 and the fixed member 37.

Figure 6:
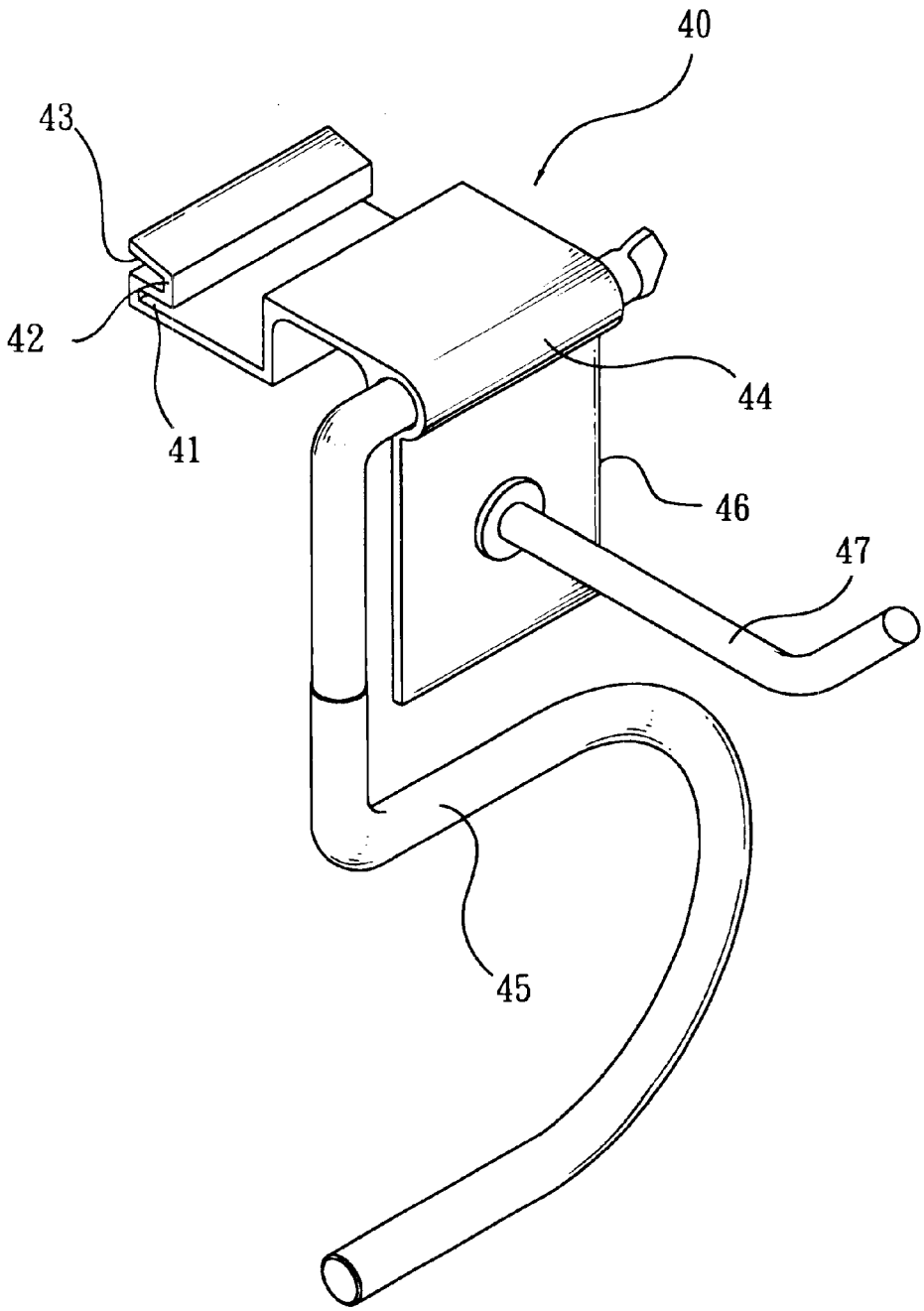
FIG. 6 is an enlarged perspective view to show another embodiment of the hook assembly of the tool holding device of the present invention.

FIG. 6 shows an extension plate 46 extends from the connection plate 44 and a hanging pin 47 extends from the extension plate 46 so as to hang clothes or small tools.

While we have shown and described various embodiments in accordance with the present invention, it should be clear to those skilled in the art that further embodiments may be made without departing from the scope of the present invention.

What is claimed is:

1. A tool holding device comprising:

a channel member having a bottom and opposed longitudinal sides defining a channel therebetween, said channel member having a first groove in each respective side opening into said channel, and a second groove defined in a surface of at least one of said sides facing away from said channel;

a clamping assembly having ridges which are movably received in said first grooves of said channel member, two holes defined in said clamping assembly and a fixed member extending from said clamping assembly, a clamp member having a passage defined eccentrically therein and a pin removably extending through said passage and engaged with one of said two holes, and a hook assembly having a hook arranged to extend outwardly from said at least one side and a connection portion which is movably engaged within said second groove.

2. The device as claimed in claim 1 further comprising two notches defined in said clamping assembly and a cover connected to said clamping assembly to enclose said clamp member in said cover, said cover having two lugs which are engaged with said notches.

3. The device as claimed in claim 2 further comprising a magnetic member connected on said cover.

4. The device as claimed in claim 1 further comprising two end members engaged on two ends of said channel member and blocking said first grooves so as to prevent said clamping assembly from disengaging from said channel member.

5. The device as claimed in claim 1 further comprising a flange extending from said bottom of said channel member and said channel member having a first inclined surface, said connection portion having a third groove and a second inclined surface so that said flange is received in said third groove and said second inclined surface is engaged with said first inclined surface.

6. The device as claimed in claim 1 further comprising an extension plate extending from said connection portion and a hanging pin extending from said extension plate.

* * * * *